US005333691A

United States Patent [19]

Dean et al.

[11] Patent Number: 5,333,691

[45] Date of Patent: Aug. 2, 1994

[54] ROV INSTALLABLE JUNCTION PLATE AND METHOD

[75] Inventors: James L. Dean, Spring; Rodney K. Seto, Missouri City; Sheldon L. Kovit, Houston, all of Tex.

[73] Assignees: BHP Petroleum Pty Ltd.; FSSL, Incorporated, Melbourne, Australia

[21] Appl. No.: 66,877

[22] Filed: May 25, 1993

[51] Int. Cl.[5] ..... E21B 41/04; F16L 35/00; F16L 37/08

[52] U.S. Cl. ..... 166/341; 166/344; 166/65.1; 285/26; 285/137.1; 439/364; 439/577

[58] Field of Search ..... 166/338, 341, 360, 340, 166/366, 344, 379; 285/19, 26, 137.1; 439/364, 368, 378, 483, 577

[56] References Cited

U.S. PATENT DOCUMENTS

| | | | |
|---|---|---|---|
| 4,191,256 | 3/1980 | Croy et al. | 166/344 X |
| 4,194,857 | 3/1980 | Chateau et al. | 405/203 |
| 4,611,831 | 9/1986 | Truchet | 285/26 |
| 4,643,616 | 2/1987 | Castel et al. | 405/191 |
| 4,648,629 | 3/1987 | Baugh | 285/26 |
| 4,699,402 | 10/1987 | Stoll et al. | 285/26 |
| 4,915,419 | 4/1990 | Smith, III | 285/26 |
| 5,024,467 | 6/1991 | Truchet | 285/36 |

*Primary Examiner*—Stephen J. Novosad
*Attorney, Agent, or Firm*—Browning, Bushman, Anderson & Brookhart

[57] ABSTRACT

An improved system connects subsea coupling components mounted to a movable junction plate assembly and a fixed junction plate assembly of a subsea petroleum recovery tree. The connecting handle on a movable junction plate assembly is biased for locking engagement with a movable plate to manipulate the movable junction plate assembly, but may be unlocked upon engagement with the fixed junction plate assembly to permit rotation of the connecting handle and thereby threadedly connect the junction plate assemblies. An extension arm assembly for supporting the movable junction plate assembly may be pivotably mounted to a control pod assembly, with the extension arm being extendible and contractible to allow an ROV or diver to move the junction plate assembly within a preselected zone of control.

20 Claims, 8 Drawing Sheets

ROV INSTALLABLE JUNCTION PLATE AND METHOD

FIELD OF THE INVENTION

The present invention relates to techniques for mating and unmating multiple hydraulic and/or electrical connections. More particularly, the techniques of the present invention are directed to junction plates for making up and breaking apart such connections, wherein the movable junction plate assembly is easily interconnected with a fixed junction plate assembly in an underwater environment by an ROV or diver.

BACKGROUND OF THE INVENTION

Those familiar with subsea operations involving hydrocarbon recovery have recognized for decades that various subsea devices, such as control pods, must be powered by hydraulic or electrical lines extending to the devices from another location, such as the water surface. Since it may be necessary to repair or replace one such control pod, the hydraulic and/or electrical lines are coupled by suitable subsea connections. These connections accordingly are both made up and broken apart in the subsea environment, and those skilled in the art recognize the difficulty often encountered performing operations in a subsea environment which are relatively simple when performed in a normal atmospheric environment. Accordingly, the time and expense of utilizing a remotely operated vehicle (ROV) or a diver to perform the necessary coupling or decoupling operations can be significantly reduced if the coupling construction and method of coupling are simplified. Also, by increasing the reliability of the coupling operation, the risks associated with a more difficult and time consuming subsea operation is minimized. Accordingly, the overall costs associated with performing the subsea coupling and decoupling operations may be minimized by improved coupling technology.

ROV's traditionally have used to manipulate in position a junction plate assembly having either male or a female coupler halves, so that the moveable junction plate assembly may be secured to another plate assembly (e.g., a fixed junction plate assembly) having opposing male or female coupler halves to make up the coupled hydraulic or electrical lines. Traditionally, the movable junction plate assembly has a handle affixed thereto, which can be grasped by the arm of the ROV or diver for the purpose of manipulating the junction plate assembly to its desired position with respect to the fixed plate assembly. Once properly positioned, the ROV arm would then release the handle, and grasp a protruding drive screw of the junction plate assembly. The drive screw was subsequently rotated by the ROV to threadably connect the movable junction plate assembly to the fixed junction plate assembly. Those skilled in the art recognize that this sequence of operations, whether performed by a diver or an ROV, is somewhat cumbersome in the subsea environment. Problems have repeatedly occurred when trying to grasp either the junction plate handle or the protruding drive screw. Problems have also occurred when the movable junction plate assembly is not maintained in a secured position when the manipulating handle is released by the ROV, in which case the ROV arm may have difficulty grasping the protruding drive screw.

Additional problems are sometimes encountered when an ROV is moving a junction plate assembly from one location to another location. At times, the ROV may unintentionally release its grasp on the movable junction plate assembly, e.g., if the ROV is temporarily deactivated. When this occurs, the junction plate with the electrical and hydraulic lines connected thereto drops until it either rested on an object it strikes, or is suspended subsea from the electrical or hydraulic lines. In many cases, a falling junction plate assembly may drop to a position such that it is extremely difficult and thus costly to retrieve the junction plate assembly. Also, the dropping junction plate assembly may cause significant damage to either the junction plate assembly or to subsea components the assembly strikes, and/or may damage the hydraulic or electrical lines or their connections.

U.S. Pat. No. 4,194,857 discloses a subsea station with fluid conducting lines arranged to compensate for expansion and contraction, and to provide yieldability in the makeup connections. U.S. Pat. No. 4,611,831 discloses a connection device for connecting a series of circuits. A cylindrical lock is provided with a projecting head and a lateral pin. By compressing a biasing spring, the pin may be rotated 90 degrees to lock a first support piece to a centerpiece. The device of the '831 patent is not intended for subsea applications, and the cylindrical lock would not be easily adapted for securing a movable junction plate assembly to a fixed junction plate assembly in the reliable manner required by a subsea operators. U.S. Pat. No. 4,643,616 discloses a device for activating and connecting modules of a subsea oil production station. The device includes a telescopic articulated gib for manipulating a mechanical action connector. U.S. Pat. No. 4,915,419 discloses a locking mechanism for mating and unmating male and female coupling members in a subsea application. The apparatus includes a lock plate supported by a junction plate which is slidable between an unlocked position and a locked position. U.S. Pat. No. 5,024,467 discloses an assembly for coupling and uncoupling connection elements, such as pipes or conduits.

The disadvantages of the prior art are overcome by the present invention, and an improved movable junction plate assembly and fixed plate assembly for making up and breaking apart hydraulic or electrical couplings, and a method of connecting and disconnecting such couplings in a subsea environment, is hereinafter disclosed. The junction plate assemblies and techniques of the present invention have thus long been desired by subsea operators to meet the demands of systems which can reliably couple and uncouple hydraulic and electrical lines in subsea operations with minimal difficulty.

SUMMARY OF THE INVENTION

In one embodiment, a movable junction plate assembly having a plurality of female coupling components is manipulated by an ROV from one position to another position so that it may be mated to or disconnected from a fixed junction plate assembly having a corresponding plurality of male coupling components. A pivotable and extendable arm or boom is connected to the movable junction plate assembly. If the ROV drops its grip on the movable junction plate assembly, the assembly will still be supported from the arm, and accordingly may easily be regripped by the ROV without damaging subsea components.

The movable junction plate assembly has a center connection handle which is biased for locking to the plate of this assembly, so that the movable junction plate assembly may be manipulated by the ROV to its desired position. Once the movable junction plate assembly is properly positioned against the fixed junction plate, the handle unlocks so that it may rotate relative to the junction plate. Accordingly, rotation of the handle by an ROV thereafter easily and reliably connects the movable junction plate assembly to the fixed junction plate assembly.

Alignment of the movable junction plate assembly and the fixed junction plate assembly is provided by alignment pins separate from the coupling components, and by the threaded engagement of the handle with the fixed junction plate. An alignment guidance sleeve within the fixed junction plate assists in guiding the pins during alignment of the movable junction plate assembly with the fixed junction plate, and establishes a reliable electrical connection between the fixed junction plate and the movable junction plate to minimize galvanic corrosion. Threads on the connecting handle provide a desired highly reliable and rigid connection between the movable junction plate assembly and the fixed junction plate assembly. The flexible hydraulic and electric lines interconnected to the movable junction plate are generally positioned perpendicular to the axis of the connecting handle, so that these lines do not interfere with ROV operations. The flexible lines or hoses nevertheless may be protected by a shield spaced outwardly from the movable junction plate. A threaded bushing on the fixed junction plate may be removed and replaced from the ROV side of the fixed plate (the side which faces the movable junction plate).

It is an object of the present invention to provide improved techniques for installing and removing subsea electrical and/or hydraulic connections utilizing a remote operated vehicle or diver.

Another object of the present invention is to provide an improved junction plate assembly that can be easily installed by an ROV or diver, and which may contain either or both electrical and hydraulic connections. The junction plate assembly has a connecting handle which may be locked to the movable junction plate to facilitate manipulation of the junction plate assembly during installation. Once the junction plate assembly is properly positioned, a spring loaded fork may be moved relative to the movable junction plate to release a stop which otherwise prevents the handle from rotating relative to the movable junction plate. Once the stop is released, the connecting handle may be rotated to make up a threaded mechanical connection between the movable junction plate and the fixed junction plate. The ROV can similarly remove the movable junction plate assembly from the fixed junction plate by rotating the handle, and thereafter pulling outwardly while rotating to again lock the handle with the movable junction plate, thereby allowing manipulation of the movable junction plate assembly via the handle to its desired new position.

It is a further object of the invention to provide a subsea junction plate assembly which is supported by an extension arm to maintain the range of its movable positions within a preselected zone of control. The arm may pivot and extend inward and outward to allow the ROV or diver to install the movable junction plate assembly at different stations.

It is another object of the present invention to provide an improved subsea junction plate assembly with a single handle which may be used to both manipulate the junction plate assembly and may be rotated to secure the movable junction plate to the fixed junction plate.

It is a feature of the present invention that a subsea junction plate assembly is provided with guidance pins separate from the coupling components. The guidance pins assist in alignment of the movable junction plate and the fixed junction plate. The engagement of the connecting handle and a threaded bushing in the fixed junction plate may also assist in proper alignment of the junction plates.

It is another feature of the invention that alignment guidance sleeves or collet members are secured to the fixed junction plate for engagement with the alignment pins on the movable junction plate assembly. The guidance sleeves both assist an alignment of the junction plates, and provide a desired reliable electrical grounding connection between the movable junction plate and the fixed junction plate to minimize galvanic corrosion.

It is a further feature of the invention that the hydraulic and/or electrical lines which are connected to the movable junction plate assembly are installed at substantially right angles relative to the axis of the connecting handle, so that these flexible lines do not interfere with operation of the ROV. A shield may be spaced outward from the movable junction plate and may further protect the hydraulic hoses or electrical cable lines from the ROV or diver.

Still another feature of the invention is that the fixed junction plate may be provided with a threaded bushing for receiving a threaded portion of the connecting handle, wherein the bushing is constructed so that a damaged bushing may be removed and a new bushing installed from the ROV side of the fixed junction plate.

It is an advantage of the present invention that an upper one of the guidance pins may be significantly longer than a lower guidance pin, so that the upper guidance pin may be inserted into the fixed junction plate, and the movable junction plate thereafter may be rotated until the remaining lower guidance pin is aligned with respective apertures in the fixed junction plate.

It is a further advantage of the present invention that the connection between the movable junction plate and the fixed junction plate is provided by a reliable screw mechanism which produces the high mechanical forces desired to connect the plates.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
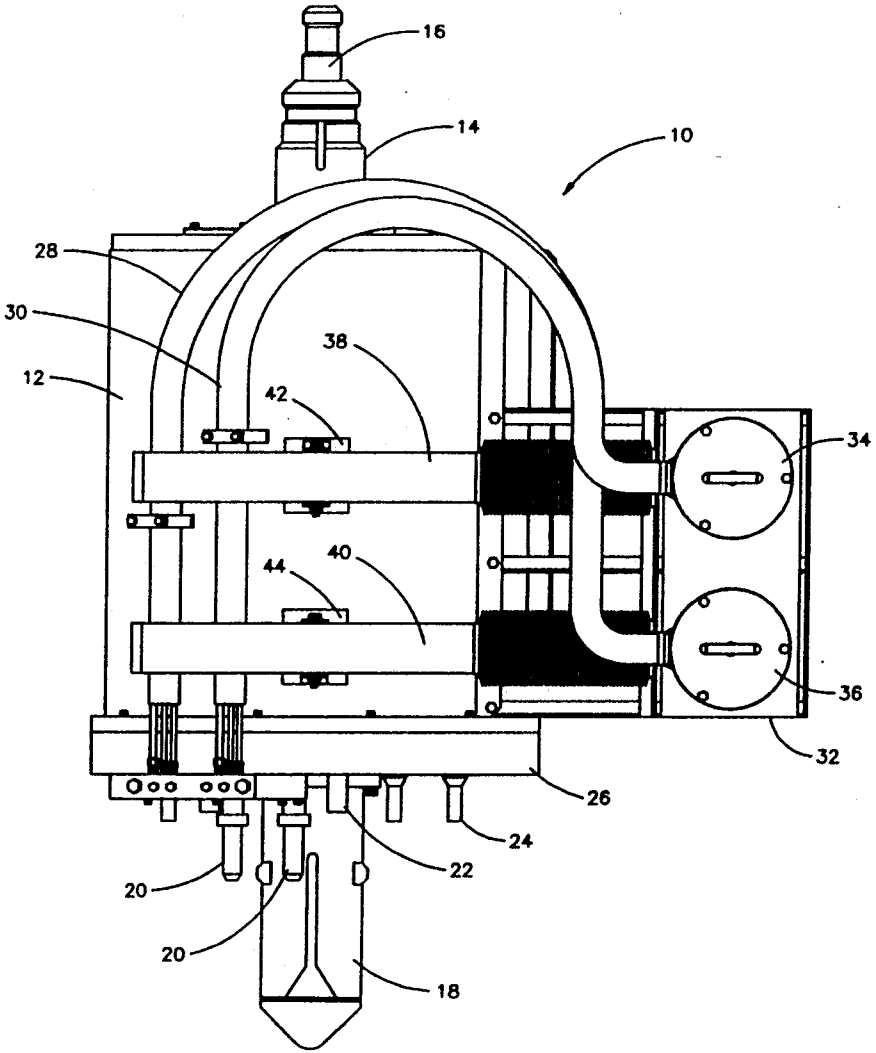
FIG. 1 is a side view of the subsea control pod assembly having a pair of movable junction plate assemblies each supported by a control arm assembly pivotably connected to the control pod outer cover.

FIG. 1 depicts one embodiment of a subsea control pod assembly 10 according to the present invention. Those familiar with the subsea petroleum recovery operations will appreciate that the control pod assembly 10 comprises a control module outer cover 12 which encloses hydraulic and/or electrical control devices (not shown) used to regulate the flow of hydrocarbons through the subsea hydrocarbon recovery system. Control pod assembly 10 is landed in its subsea environment on the subsea hydrocarbon recovery tree utilizing an upper pod mandrel 14 and the latch rod 16. Lower control pod latch housing 18 encloses a latch (not shown) for securing the assembly 10 to a landing base (not shown) on the subsea tree. Lower hydraulic couplers 20 and 22 establish the desired fluid communication between subsea components, while lower electrical connectors 24 similarly establish electrical connection between subsea components. Control pod base plate 26 supports the various hydraulic and electrical components within the outer cover 12. The control pod assembly 10 is shown to include the pair of sheath lines 28 and 30, each of which shield one or more electrical cables 30A and/or hydraulic hoses 30B discussed subsequently. Those skilled in the art will recognize that communication between a subsea petroleum recovery tree and the control pod assembly 10 may be established through the lines 28 and 30.

Figure 2:
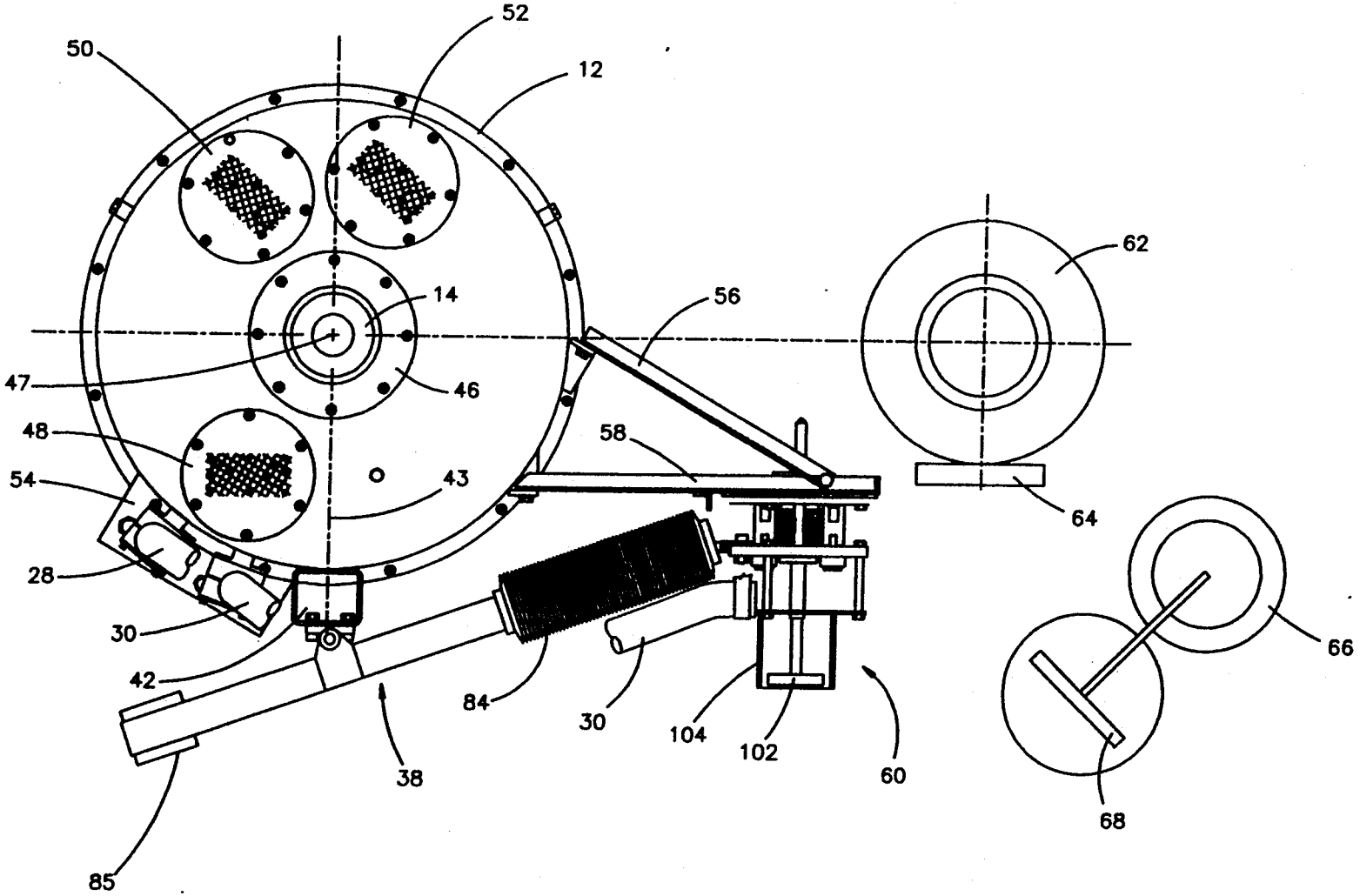
FIG. 2 is a top view of the subsea control pod generally shown in FIG. 1, and illustrating positions (a) for storing the movable junction plate assembly, (b) for running in the movable junction plate assembly with the control pod on a running tool, and (c) for connecting the movable junction plate assembly to a fixed junction plate assembly of a subsea petroleum recovery tree.

Control pod assembly 10 further includes a junction plate parking bay assembly 32, which supports an upper and a lower ROV removable junction plate assembly 34 and 36, respectively. Each of the junction plate assemblies 34 and 36 in turn are supported by a respective upper and lower extension arm assembly 38 and 40. Each assembly 38 and 40 is secured to the outer cover or housing 12 by a respective upper and lower arm mount or connection member 42, 44. FIG. 2 is a top view of the assembly 10 shown in FIG. 1, and illustrates that the subsea control pod assembly 10 further includes a plurality of housing pressure compensator covers 48, 50 and 52, each of which allows the ambient pressure of the water to be communicated through a flexible bladder (not shown) to the inside of the fluid filled control pod 10. FIG. 2 also depicts the control pod mandrel seal flange 46 centered about vertical axis 47, and a manifold block 54 which extends radially outward from the outer cover 12. A plurality of parking bay support frame members 56 and 58 support the parking bay assembly 32. The parking bay assembly provides a mount for the junction plate assembly 60 shown in FIG. 2, which assembly 60 may be either of the assemblies 34 or 36 shown in FIG. 1.

FIG. 2 simplistically illustrates a conventional position for the control pod assembly 10 with respect to a running tool guide tube 62, which has a tool parking bay 64 secured thereto. Those skilled in the art will understand that the assembly 60 may be secured to the parking bay 64 while the subsea control pod assembly 10 is lowered into position on a platform of a subsea petroleum production tree. After being run in, the assembly 60 may be returned to the position as shown in FIG. 2, and also may be moved for securing the assembly 60 to the tree mounted junction plate 68 of the support post 66 of the subsea tree.

Figure 3:
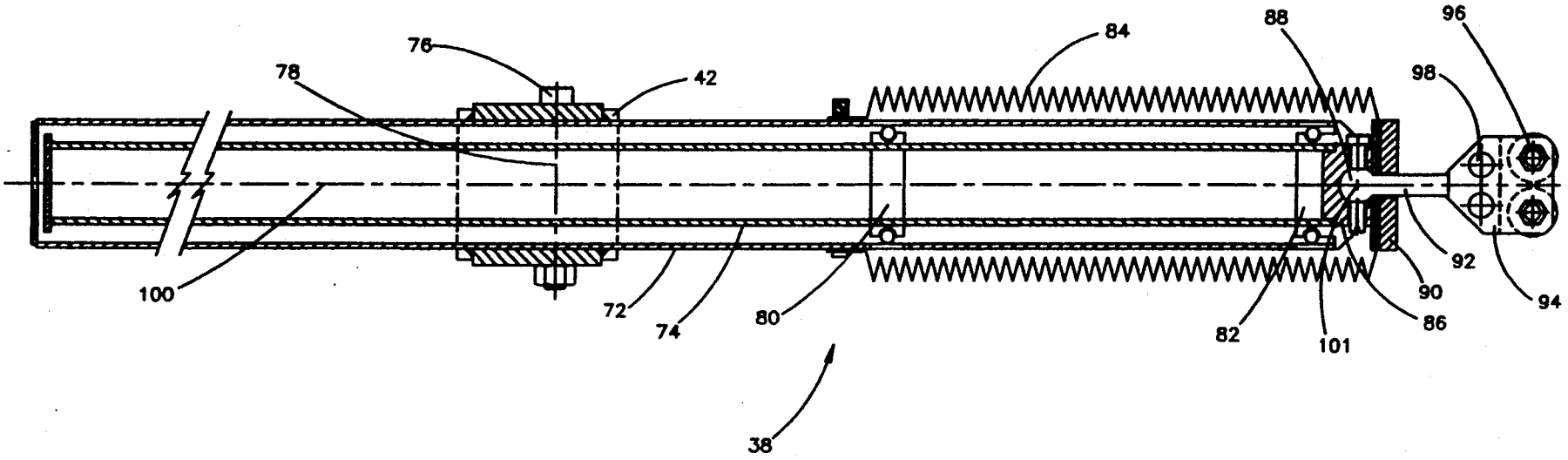
FIG. 3 is a more detailed view, partially in cross-section, of a suitable arm assembly for supporting the movable junction plate assembly from the control pod outer cover according to the present invention.

Referring now to FIG. 3, the upper extension arm assembly 38 may be structurally identical to the lower extension arm assembly 40, and may comprise an extension arm outer sleeve 72 having an inner sleeve 74 telescopingly received therein. Extension arm outer sleeve 72 is mounted to the upper mount 42 with a gimble pin 76 which allows rotation of the extension arm assembly 38 about the axis 78 as shown in FIG. 3. Spacer and roller subassemblies 80 and 82 facilitate easy telescopic movement of the inner sleeve 74 with respect to the outer sleeve 72. An expandable extension arm protective cover 84 is secured at one end to the outer sleeve 72, and at the other end to extension arm clevis retainer 90 having arm clevis 92 passing therethrough. A ball member 88 is provided at one end of the extension arm clevis retainer 90, while an extension arm plate 94 having a plurality of apertures 98 for receiving nut and bolt assemblies 96 is provided at the opposing end of the clevis 92. Extension arm clevis ball 88 is mounted to extension arm clevis socket 86, which is secured to the cantilevered or free end of the inner sleeve 74. The retainer 90 and the extension arm clevis 92 may thus extend along the axis 100 with respect to the outer sleeve 72. Fluid communication between the subsea environment and the components within the extension arm assembly 38 is permitted, although the combination of the outer sleeve 72 and protective cover 84 provide a desired shield to keep debris from interfering with the reliable operation of inner extension arm assembly components, and keep barnacles and other marine life from interfering with movement of the inner sleeve relative to the outer sleeve. As explained subsequently, the nut and bolt assemblies 76 may be used to secure the junction plate assembly 60 to the extension arm assembly 38.

Figure 4:
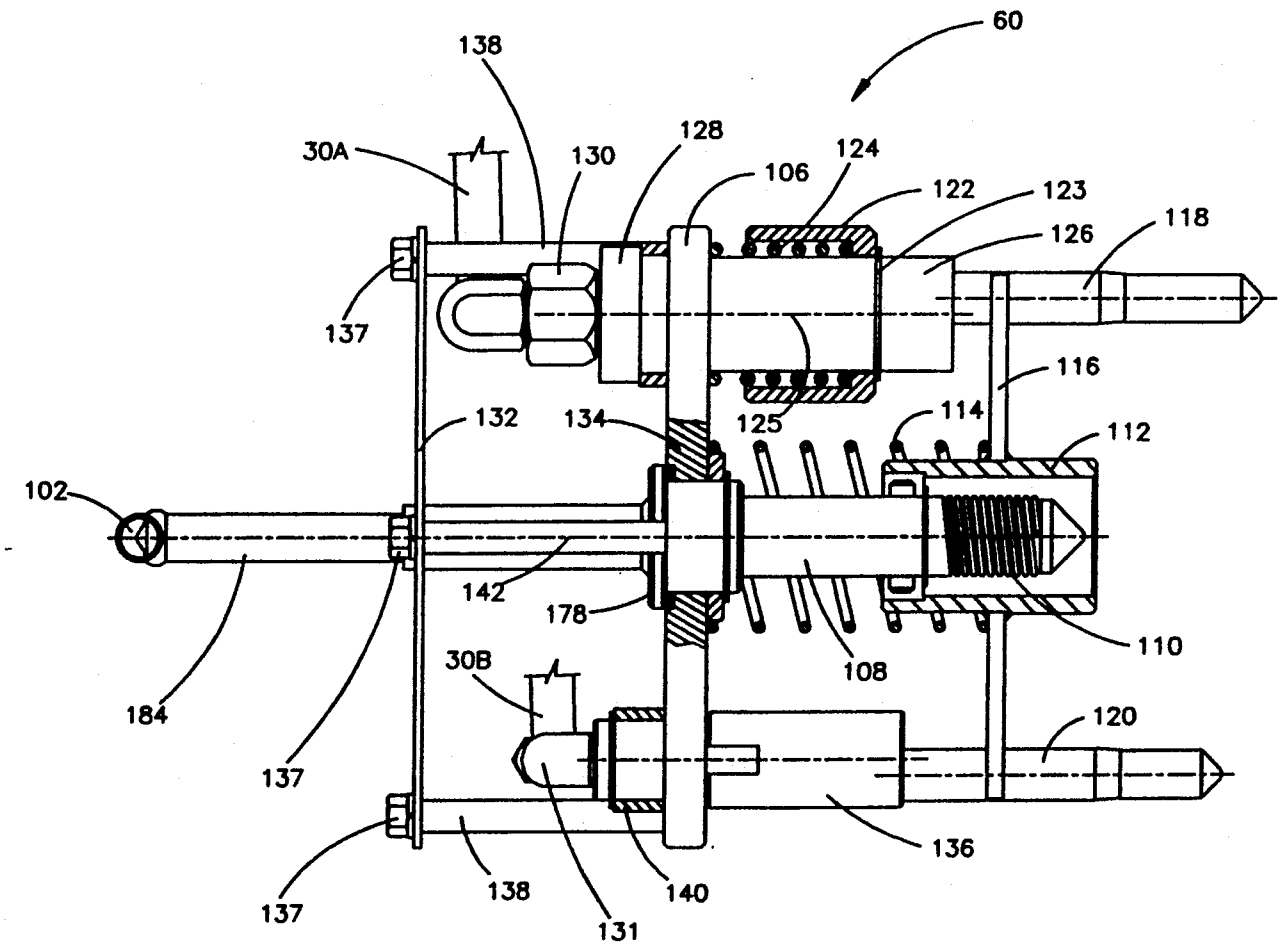
FIG. 4 is a detailed cross-section view of a movable junction plate assembly according to the present invention.

Referring now to FIG. 4, the upper ROV movable junction plate assembly 60 includes an ROV grasping member, which conventionally may take the form of T-handle 102 at the end of the shaft 184. Those skilled in the art will appreciate that an ROV arm or a diver may easily grasp the handle 102 (which at this stage is substantially fixed with respect to plate 106) and manipulate the position of the handle and thereby the junction plate assembly with respect to the subsea control pod assembly 10. When the handle 102 subsequently becomes rotatable relative to plate 106, the ROV may rotate the T-handle 102 about the axis 142. An ROV movable junction plate 106 is mounted to the T-handle shaft 184, and shaft extension member 108 extends through an aperture provided in the plate 106, and has drive screw threads 110 at the end opposite the T-handle 102. Anti-rotation fork 116 includes a sleeve-shape member 112. Compression spring 114 surrounds the member 112, an acts between the fork 116 and the plate 106 to bias the fork away from the plate 106.

Also extending through the plate 106 is a long alignment pin 118, and a short alignment pin 120. Each of the pins 118, 120 is used for subsea alignment of the assembly 60 as described subsequently. The spring cup 122 may be biased by compression spring 124 into engagement with the stop 123, which may consist of a retainer clip secured in a groove about the electrical connector 126. The cup 122 and spring 124 allow the electrical connector 126 to move along axis 125 with respect to plate 106, thereby minimizing the difficulty associated with proper alignment and mating of the male and female electrical connectors. The same biasing concept may be used, but frequently may not be necessary, for proper mating of the hydraulic connections. The end 128 of the electrical connector 126 on the opposing side of the junction plate 106 may receive a threaded fitting 130 provided at the end of electrical line 30A. To protect the electrical connector 126 and the line 30A, a protective hose and cable cover 132 may be secured to the plate 106 by a plurality of bolt and nut assemblies 137 each passing through a spacer 138 mounted between the cover 132 and the plate 106. Hydraulic coupler protector 136 is also mounted to the plate 106 for housing a hydraulic coupler for fluid communication with hydraulic line 30B, with spacer 140 provided between connection 131 at the end of line 30B and the plate 106.

Figure 5:
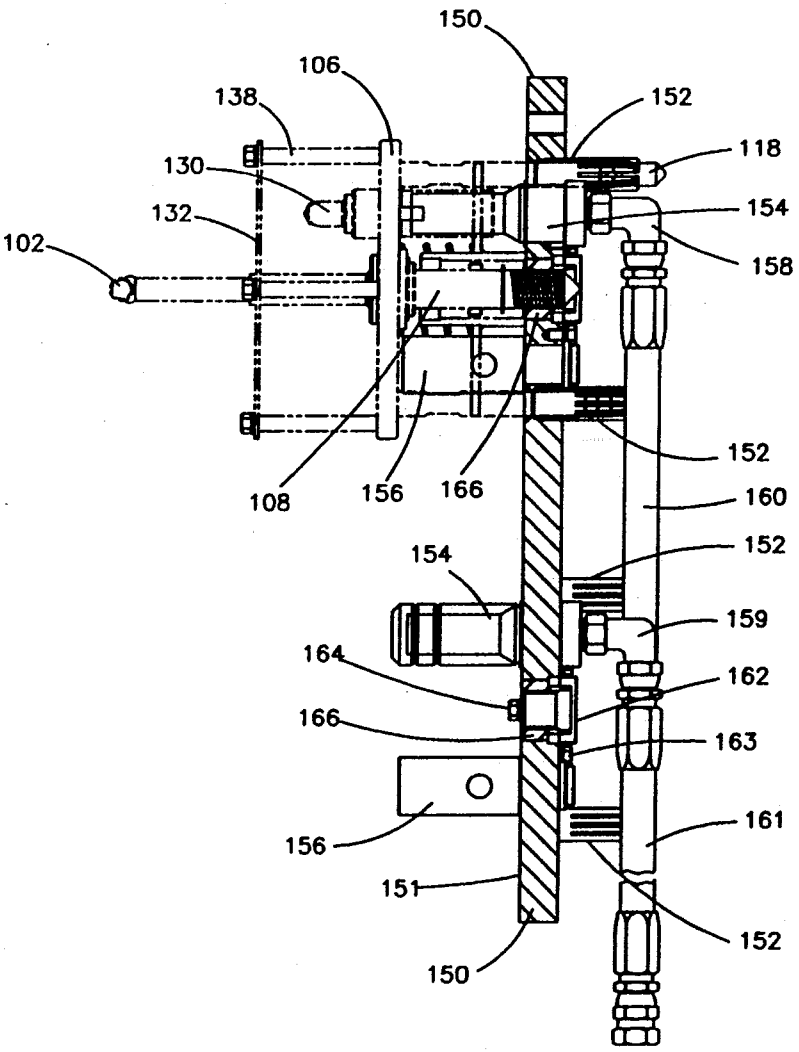
FIG. 5 is a cross-section view of one movable junction plate assembly according to the present invention mated to a fixed junction plate assembly.

FIG. 5 depicts one version of a tree mounted junction plate 150, which is provided for mounting the junction plate assembly 60, thereto and thereby establish hydraulic and electrical communication between the control pod and the tree. Secured to the plate 150 are a plurality of alignment guidance sleeves 152 for receiving the alignment pins 118, 120 described above. FIG. 5 also depicts a pair of mating electrical connectors 154 each for electrical connection to a corresponding one of the electrical connectors 126, and a pair of hydraulic coupler protectors 156 each for cooperation with a respective coupler 136 as shown in FIG. 4 to house a hydraulic coupler. A threaded fitting 158 extends from the electrical connector 154, and protective sheath 160 may thus house a plurality of electrical lines. A similar fitting 159 may be provided for the electrical lines housed within the protective sheath 161 in order the obtain the redundancy desired for subsea operations. Corresponding sheaths not shown in FIG. 5 may be provided for redundant hydraulic lines, each of which may be connected to a suitable hydraulic coupler component within protector 156. A drive screw receiver bushing 166 is mounted within the plate 150, and has threads for mating engagement with threads 110 of a respective connecting shaft. A drive screw grounding bracket 162 may be secured to the plate 150 by a plurality of retaining bolts 163. The bushing 166 is discussed further below.

Figure 6:
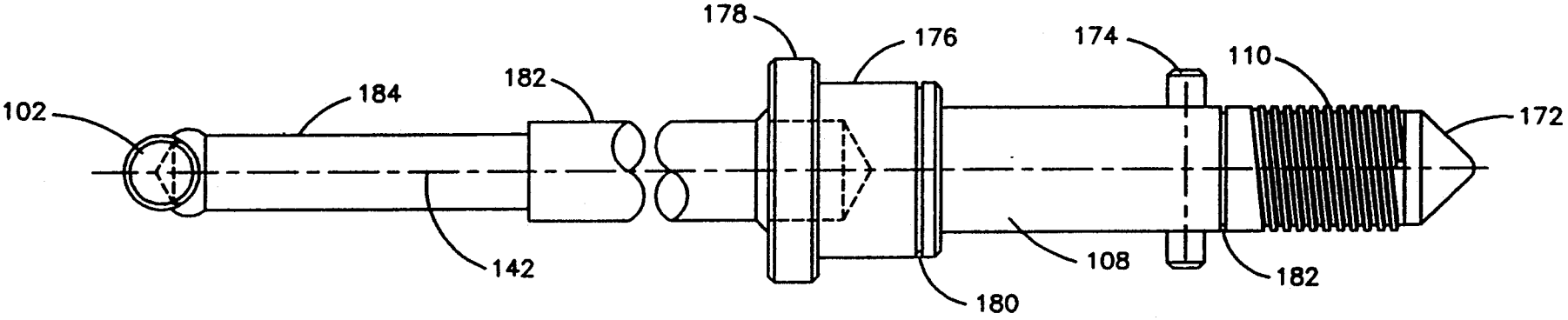
FIG. 6 is a detailed view of the connecting handle of the movable junction plate assembly generally shown in FIG. 4.

FIG. 6 depicts in greater detail the T-handle assembly generally shown in FIG. 4. A drive screw retainer 178 may be welded to T-handle shaft 184, with cylindrical guide portion 176 of shaft 184 including a ring groove 180 for receiving a suitable retaining ring (not shown) to secure the position of the shaft 184 with respect to the plate 106 along the axis 142. A similar groove 182 in the shaft extension 108 receives a similar retaining ring to limit travel of the fork 116 away from the plate 106 in response to spring 114. Drive screw threads 110 are provided at the end of the shaft extension member 108 containing the drive screw nose member 172, which facilitates insertion of the drive screw shaft 184, and specifically shaft extension member 108 thereof, into the bushing 166.

Figure 7:
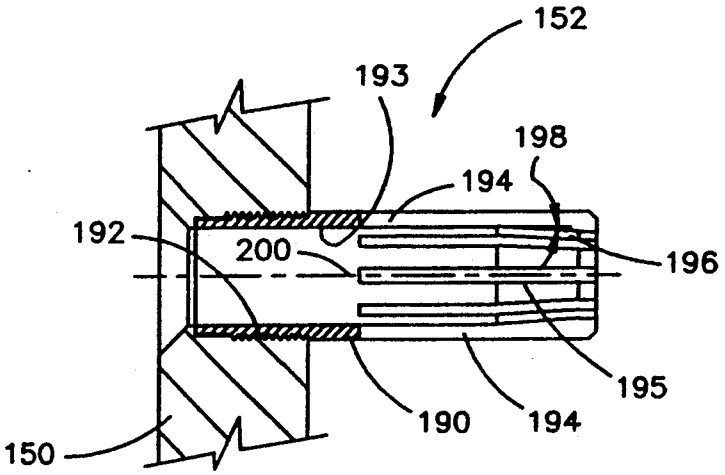
FIG. 7 is a detailed view, partially in cross-section, of an alignment guidance sleeve secured to a portion of the fixed junction plate generally shown in FIG. 4.

FIG. 7 illustrates in greater detail one alignment guidance sleeve 152 secured to the plate 150. Guidance sleeve 152 comprises a body 190 having threads 192 thereon for engagement with corresponding threads provided in the plate 150. A plurality of interference fit tines 194 are spaced about the periphery of the body 190 and extend outward from the plate 150, with adjacent tines having a uniform spacing 195 therebetween. Each tine may have a radially inward extending tapered surface 196 which is provided at an interference angle 198 with respect to guidance sleeve centerline 200. Four, six, or eight tines may be provided at a uniform circumferential spacing about body 190.

Figure 9:
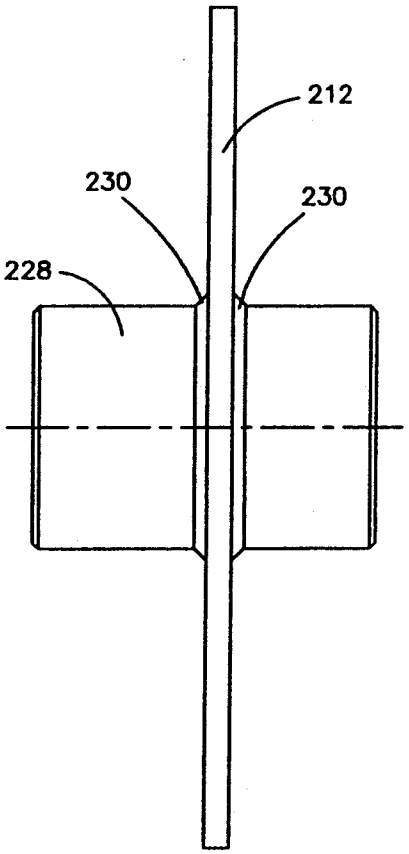
FIGS. 8 and 9 are front and side views, respectively, of a suitable locking device, such as a fork member, for selectively locking the connecting handle to the junction plate of the movable junction plate assembly.
Figure 8:
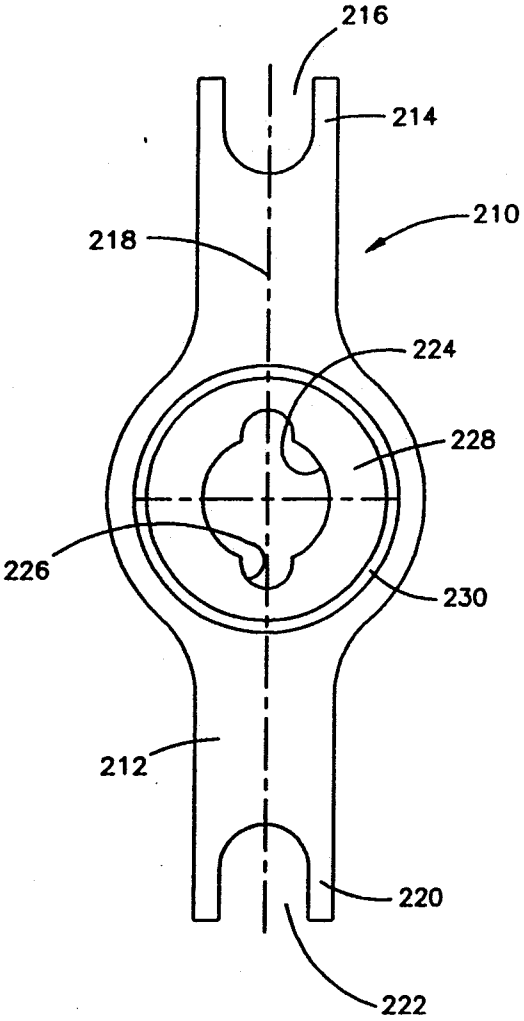

FIGS. 8 and 9 depict one embodiment of an anti-rotation fork or locking device 210, which may be similar to the fork 116 generally shown in FIG. 4. Fork 210 comprises a body 212 which is generally symmetrical about fork axis 218. A pair of projecting tabs 214 are formed by guide pin notch 216 at one end of body 212, while similar projecting tabs 220 are defined by guide pin notch 222 at the opposing end of the body 212. Sleeve portion 228 of the fork 210 has a generally cylindrical through aperture 224 therein, and an anti-rotational slot 226 is also formed in the sleeve portion 228. The length of the slot 226 may be aligned with the centerline 218. Welds 230 are shown fixedly connecting the body 212 and the sleeve portion 228.

Referring now to FIGS. 1 and 2, the subsea control pod assembly 10 may be landed with the ROV removable junction plate assemblies 34 and 36 as shown in FIG. 1 (or assembly 60 as shown in FIG. 2) fixed to the parking bay 64 of the running tool 62. Thereafter, the integrity of the hydraulic and electrical systems may be checked, with the running tool still attached to the control pod assembly 10. After system integrity is assured, an ROV or diver may disconnect the junction plate assembly 60 as shown in FIG. 2 from the running tool 62, then move the junction plate assembly 60 to a position for attachment to the parking bay assembly 32 supported by support frames 56 and 58, and thus to the control pod assembly 10. The control pod assembly 10 thus remains subsea while the running tool is removed, with the junction plate assembly being mounted to the control pod assembly. Thereafter, the same or another ROV or diver may move the junction plate assembly 60 from the position as shown in FIG. 2 for attaching the junction plate assembly 60 to the junction plate 68, which in turn is secured to the support post 66 on a subsea tree. If it is thereafter necessary or desirable to disconnect the hydraulic and electrical lines within the protective sheaths 28 and 30 from the tree and thus the tree support 66, e.g., when removing or replacing the control pod assembly 60, the junction plate assemblies may be removed from the junction plate 68 of the tree, and moved back to its position as shown in FIG. 2 so that the junction plate assembly is then again supported by the parking bay 32 and support frames 56 and 58. A new or repaired control pod assembly 10 may be run in, then hydraulically and electrically connected to the subsea tree in a manner described above.

Still referring to FIG. 2, it should be understood that the extension arm assemblies 38 and 40 each allow the respective junction plate assembly to be moved within a preselected zone of control. This zone of control is defined by the positions of (a) the junction plate parking bay 32 supported by the control pod assembly 10, as shown in FIG. 2, (b) the parking bay 64, and (c) the tree mounted junction plate 68. Each of the upper and lower extension arm assemblies 38 and 40 as shown in FIG. 1 is thus pivotably mounted with respect to the control pod assembly 10, and is extendable and contractible so that the position of the junction plate assembly at the end of the extension arm assembly can move with respect to the control pod assembly, so that the junction plate assembly can move for engagement with 64 or 68 as shown in FIG. 2. Those skilled in the art will appreciate that the ROV or diver may cause extension or retraction by pulling or pushing on the junction plate assembly to move the inner sleeve 74 with respect to the outer sleeve 72, and that the cover 84 protects seals the components within each of the extension arm assemblies. Referring to FIG. 3, both the inner and outer sleeves 74 and 72, which together form the extension arm, may thus pivot about axis 78, thereby permitting lateral or horizontal movement of the junction plate assembly mounted at the cantilevered end of the extension arm to the control pod assembly. The ROV may move the inner sleeve along axis 100, which is perpendicular to axis 78. The extension arm mount or connection member 42 as shown in FIGS. 1 and 2 also permits a limited vertical movement of the junction plate assembly relative to the control pod assembly, and accordingly plate 42 may pivot within a preselected arc angle about axis 43 (see FIG. 2) plate to the control pod assembly cover 12. The nut and bolt assemblies 96 may thus be used to secure the assembly 60 as shown in FIG. 4 to the plate 94 of each extension arm assembly.

It is a feature of the invention that extension arm assemblies are provided for preventing the junction plate assembly from dropping in the underwater environment to a location which may be difficult or expensive to retrieve by an ROV or diver. Each of the extension arm assemblies thus allows movement of the junction plate assembly within the zone of the control determined by the position of the components as shown in FIG. 2. This zone of control is substantially restricted, however, so that if the assembly 60 is inadvertently dropped by an ROV or a diver, the extension arm assembly from the junction plate assembly is supported will maintain the junction plate assembly within the zone of control so that it may be more easily retrieved. In one embodiment, the zone of control provided by the extension arm assembly may allow the junction plate assembly to drop approximately 1 meter and/or to move laterally with respect to the subsea control pod assembly 10 to a position slightly outside of the zone needed to enable the junction plate assembly to be moved to each of the various positions desired. Even if the junction plate assembly is inadvertently dropped, the general position of the junction plate assembly is known, and the support provided by the extension arm assembly allows the ROV or diver to more easily grasp a dropped junction plate assembly, and also prevents damage to subsea components.

Referring to FIGS. 2 and 3, it should also be understood that the pivotable connection between the outer sleeve and the mounting bracket 42 secured to the control pod cover 12 allows the junction plate assembly to be moved within the desired zone of control. The extension arm assembly preferably is mounted so that a portion of the extension arm assembly opposite the extension arm clevis 92 with respect to the axis 78 assists in counterbalancing some of the weight which the ROV or diver must expend to lift the junction plate assembly 60 at the cantilevered end of the arm. If desired, additional weighting devices, simplistically shown as weight 85 in FIG. 2, may also be used to further assist in reducing the effort required by the diver or ROV.

Still referring to FIG. 3, it should be understood that each extension arm assembly preferably is also provided with a mechanism such as extension arm clevis 92 having a ball joint component 88 which allows the clevis 92 to be pivotably moved in any direction about centerpoint 101 with respect to extension arm clevis socket 86. This feature ensures easy maneuvering of the junction plate assembly by the ROV or diver for positioning to any one of the mounting position as shown in FIG. 2.

Referring now to FIG. 4, the junction plate assembly may have a plurality of alignment pins, with one such pin (such as alignment pin 118) preferably being longer than the remaining alignment pins. This feature allows pin 118 to be positioned by the ROV or diver for insertion within a respective aperture provided in a mounting plate, such plate 150, then the assembly 60 rotated about the axis of pin 118 until the shorter alignment pins are positioned for insertion within their respective apertures in the mounting plate. Both the alignment pins 118, 120 and the shaft extension member 108 thus may assist in aligning the hydraulic and electrical components prior to their being coupled together. FIG. 4 illustrates the fork 116 in its locked position, so that rotation of the shaft 118 with respect to plate 106 is not permitted. Referring to FIGS. 4, 6, 8 and 9, it should be understood that notches 216 and 222 receive the alignment pins 118 and 120, respectively, and thus the projecting tabs 214 and 220 prevents rotation of fork 116 with respect to alignment pins and thus with respect to plate 106. When the spring 114 biases the fork 116 to the locked position as shown in FIG. 4, dowel pin 174 which is pressed fitted into fixed engagement with the shaft extension member 108 is positioned within the elongate slot 226 within the sleeve 228 of the fork 116, thereby acting as a stop to prevent rotation of the shaft 184 with respect to plate 106.

When the assembly 60 as shown in FIG. 4 is positioned so that pins 118 and 120 are received within respective apertures provided in the plate 150, the fork 116 is engaged and moved toward plate 106, thereby compressing the spring 114. Movement of the fork 116 toward the plate 106 moves the dowel pin 174 out of the slot 226, thereby allowing rotation of the shaft extension member 108 and the dowel pin 174 with respect to the fork 116. At this time, the ROV or diver may thus rotate the T-handle 102 about the axis 142, since the pins 118 and 120 maintain the hydraulic and electrical coupling components in proper alignment for mating. The nose 172 is thus generally centered for insertion in the aperture provided within the bushing 166 in the plate 150, and the subsequent rotation of the T-handle 102 causes threaded engagement of the shaft extension member 108 to the bushing 166 and thus to plate 150. According to the present invention, a desired threaded connection may thus be obtained between the junction plate assembly 60 and the tree mounted junction plate 150, although the ROV or diver which accomplishes this task has merely had to grasp the T-handle 102 one time, and thereafter may manipulate the junction plate assembly 60 and then connect the junction plate assembly to the tree mounted junction plate without releasing its grasp on handle 102.

FIG. 5 illustrates the fixed or tree mounted junction plate 150, with an upper movable junction plate assembly secured thereto for establishing electrical and fluid communication between the control pod assembly and the subsea tree. The corresponding lower junction plate assembly is not depicted in FIG. 5, so that the fixed junction plate assembly components are easily appreciated. In the lower portion of FIG. 5, the bushing 166 for receiving threads 110 on shaft 184 is depicted. According to the present invention, this bushing 166 is removable from the plate 150 so that a worn or damaged bushing can be replaced with a new bushing. It is a feature of this invention that each bushing 166 is removable from the ROV side 151 (which is also the movable junction plate side) of the plate 150, since the opposing side of the fixed junction plate 150 is not normally readily accessible to the ROV or diver.

The bushing 166 is secured to the plate 150 by one or more bolts 164 which are accessible for threading and unthreading from the side 151, with the bolts 164 being offset laterally with respect to the central axis of the bushing 166 so that they do not interfere with the insertion of the shaft 184 into the bushing 166. Alternatively, flats may be provided on the threaded bushing may engage stop surfaces on the plate 150 to prevent rotation of the mounted bushing 166 with respect to the plate 150. The bushing 166 may be mounted to the plate 150 by a bushing insertion-and-rotation operation, so that the body of the plate 150 prevents the bushing from moving toward the movable junction plate assembly as the threaded connection is being made up. Various other techniques for removably interconnecting the threaded bushing 166 and plate 150 may be utilized, and the preferred technique will balance manufacturing costs and the desired ease of removing and replacing the threaded bushing with a new bushing using an ROV or diver. The drive screw grounding bracket 162 provides an electrical grounding between the plate 150 and the shaft 184.

FIG. 7 illustrates one alignment guidance sleeve 152 threaded to plate 150. The plurality of circumferentially spaced tines 194 may be formed by saw cutting a sleeve to form gaps 195 between adjacent tines. The alignment guidance sleeve provides an elongate bore 193 along body 190, which bore continues along axis 200 through the plurality of tines. The bore 193 assists in guiding the pin during alignment of the movable junction plate assembly with respect to the fixed junction plate, and allows the plate 150 to desirably remain relatively thin. The inwardly projecting tapered surfaces 196 on each tine engage a respective alignment pin, and establish a reliable electrical grounding connection between the fixed junction plate and the movable junction plate assembly to minimize galvanic corrosion. The tapered surfaces 196 on each of the tines may have an angle 198 of approximately 10 degrees, and preferably between about 3 degrees and 15 degrees.

According to the method of the present invention, the subsea control pod assembly 10 is landed on a base with the fluid junction plate assemblies supported on the running tool, as previously described. Once the running tool has been returned to the surface, a diver or ROV may disconnected the movable junction plate assembly from the control pod assembly, and move the junction plate assembly for interconnection with a subsea petroleum recovery tree, which may have a fixed junction plate assembly 68 positioned as shown in FIG. 2. During movement of the movable junction plate assembly, the extension arm assembly which has a junction plate assembly supported at the free end thereof may pivot with respect to the control pod assembly, and is also extendible and retractable as previously explained, so that the movable junction plate assembly is desirably movable while also being maintained within a preselected zone of control. When the movable junction plate assembly is generally positioned for engagement with the fixed junction plate assembly 68, the movable junction plate assembly may be rotated about the centerpoint 101 of the ball member 88, as previously described. The ROV or operator may then insert the long alignment pin within an aperture provided in the fixed junction plate assembly, then rotate the movable junction plate assembly so that the one or more short pins are aligned for insertion within their respective apertures in the fixed junction plate. During this entire process, the handle 102 which is grasped by the ROV or operator need not be disconnected, since the shaft extension member 108 remains substantially fixed with respect to the plate 106.

The ROV or diver then moves the movable junction plate inward in a direction aligned with axis 142 for engagement with the fixed junction plate, which movement causes the engagement of the fixed junction plate and the sleeve-shaped portion 112 of the fork 116. Continued inward movement of the movable junction plate assembly compresses the spring 114, and effectively removes the stop which previously prevented rotation of the shaft 184 (or shaft extension member 108) with respect to the movable junction plate 106. The ROV or operator may then rotate the shaft 184 so that threads 110 engage the corresponding threads on the bushing 166. In this manner, the male and female coupling components attached to the fixed junction plate and movable junction plate will become mated, thereby establishing the desired fluid and/or electrical communication between the control pod assembly and the lines extending from the fixed junction plate to the various tree components. According to the techniques of the present invention, the movable junction plate assembly is continually maintained within the preselected zone of control even if the ROV or diver should drop the movable junction plate assembly, although the likelihood of this dropping is minimized since the handle which is initially grasped by the ROV or operator to manipulate the movable junction plate assembly may be continually grasped and thereafter merely rotated to secure the fixed junction plate assembly to the movable junction plate assembly.

To remove the movable junction plate assembly from the fixed junction plate assembly, the ROV or operator may rotate the connecting handle, and thereafter pull the movable junction plate assembly outward a short distance while continuing to rotate the handle, thereby again locking the connecting handle to the movable junction plate 106. This allows the ROV or operator to manipulate the movable junction plate by the handle to its desired position, so that it can be remounted in the same or a similar manner.

During alignment of the fixed and movable junction plates, the alignment guidance sleeves both assist an alignment of the junction plates, and provide a desirable reliable electrical connection between the movable junction plate and the fixed junction plate to minimize galvanic corrosion. The flexible lines which are connected to the movable junction plate are installed at substantially right angles relative to the axis of the connecting handle, so that these lines do not interfere with the operation of the ROV or diver. For added safety, shield 132 is preferably spaced from the plate 106 to further protect the hydraulic hoses or electrical lines extending to the movable junction plate assembly. If the threaded bushing within the fixed junction plate becomes damaged, the damaged bushing may removed and replaced with a new bushing by the ROV or diver from the ROV side of the fixed junction plate, as previously explained.

Those skilled in the art will appreciate that various modifications and alterations may be made to the apparatus and methods disclosed herein. The hydraulic and/or electrical couplings mated by the techniques of the present invention may transmit either or both power or control signals between the control pod assembly and the various tree components controlled by that pod. Alternatively, the couplings mated by the techniques of the present invention may transmit power or control signals generated at the surface and passed through an umbilical line to a fixed mounting plate on the tree, and then to the control pod assembly. In either case, such power and/or control signals should be understood to be included within the term "communications" as used herein. While the techniques of the present invention are particularly well suited for forming a subsea connection between control pod assembly and a petroleum recovery tree, the concepts of the present invention may be used in other subsea applications, and may also be used in other hostile environments where normal manipulation of objects is difficult and/or expensive.

The embodiments of the invention described above and the methods disclosed herein will thus suggest numerous modifications and alterations to those skilled in the art. Such further modifications and alterations may be made without departing from the spirit and scope of the invention, which should be understood to be defined by the scope of the following claims.

What is claimed is:

1. In a system including a movable junction plate assembly for interconnection with a fixed junction plate assembly of a subsea petroleum recovery tree, the movable junction plate assembly having one or more movable coupling components each supported on a movable junction plate, the movable coupling components being connected to a control pod assembly by one or more flexible lines, the fixed junction plate assembly having a corresponding one or more fixed coupling components each supported on a fixed junction plate for mated engagement with the movable coupling components transmitting communications between the control pod assembly and one or more tree components, the improvement comprising:

movable junction plate assembly having a connecting handle with a movable securing member at one end thereof for engagement with the fixed junction plate, one or more of alignment pins for positioning within respective apertures within the fixed junction plate for alignment of the respective movable and fixed coupling components, a locking member for securing the connecting handle to the movable junction plate when in a locked position while permitting rotation of the connecting handle with respect to the movable junction plate when in an unlocked position, and a biasing member for biasing the locking member to a locked position; and the fixed junction plate assembly having a fixed securing member for engagement with the movable securing member on the connecting handle to interconnect the movable junction plate assembly and the fixed junction plate assembly, and one or more apertures within the fixed junction plate each for receiving a respective one of the plurality of alignment pins.

2. The improvement as defined in claim 1, further comprising:

the movable securing member on the connecting handle including threads; and the fixed securing member on the fixed junction plate including mating threads for threaded engagement with the threads on the connecting handle.

3. The improvement as defined in claim 2, wherein the mating threads on the fixed junction plate are provided on a bushing member removably affixed to the fixed junction plate.

4. The improvement as defined in claim 3, further comprising:

one or more securing members for securing the bushing member to the fixed junction plate such that the bushing member may be disconnected with the fixed junction plate from a side of the fixed junction plate facing the movable junction plate assembly.

5. The improvement as defined in claim 1, wherein one of the one or more alignment pins extend axially from the movable junction plate a distance greater than other of the one or more alignment pins.

6. The improvement as defined in claim 1, wherein the locking member is interconnected with at least one of the one or more alignment pins.

7. The improvement as defined in claim 6, wherein the biasing member is a spring acting between the movable junction plate and the locking member.

8. The improvement as defined in claim 6, further comprising:

a stop member on the connecting handle for engagement with the locking member when in the locked position.

9. The improvement as defined in claim 1, wherein the one or more movable coupling components each supported on the movable junction plate comprise a plurality of coupling components each spaced from the connecting handle.

10. The improvement as defined in claim 1, wherein the one or more fixed coupling components each supported on the fixed junction plate comprises redundant coupling components for transmitting redundant communication signals from the control pod assembly to the one or more tree components.

11. The improvement as defined in claim 1, further comprising:

a protective shield spaced between the fixed junction plate and a grasping end of the connecting handle, the protective shield providing a spacing between the fixed junction plate and the protective shield for receiving portions of the one or more flexible lines to protect the one or more flexible lines.

12. In a system including a movable junction plate assembly for interconnection with a fixed junction plate assembly of a subsea petroleum recovery tree, the movable junction plate assembly having one or more movable coupling components each supported on a movable junction plate, the movable coupling components being connected to a control pod assembly by one or more flexible lines, the fixed junction plate assembly having a corresponding one or more fixed coupling components each supported on a fixed junction plate for mated engagement with the movable coupling components for transmitting communications between the control pod assembly and one or more tree components, the improvement comprising:

an extension arm assembly mounted to the control pod assembly for supporting the movable junction plate assembly, the extension arm assembly including an extension arm extendible and retractable along an extension axis, a connection member for pivotably connecting the extension arm to the control pod assembly, and a mounting member for supporting the movable junction plate assembly from a cantilevered end of the extension arm assembly, the extension arm assembly allowing movement of the movable junction plate assembly within a preselected zone of control while secured to the mounting member.

13. The improvement as defined in claim 12, wherein the connection member is adapted for permitting both horizontal and vertical movement of the movable junction plate assembly supported on the mounting member with respect to the control pod assembly.

14. The improvement as defined in claim 12, wherein the extension arm assembly further comprises an outer sleeve and an inner sleeve telescopingly received within the outer sleeve.

15. The improvement as defined in claim 14, wherein the extension arm assembly further comprises:

a clevis member pivotable about a centerpoint with respect to the inner sleeve for supporting the mounting member and thus the movable junction plate assembly from the cantilevered end of the extension arm assembly.

16. A method of connecting subsea coupling components in a system including a movable junction plate assembly for interconnection with a fixed junction plate assembly of a subsea petroleum recovery tree, the movable junction plate assembly having a connecting handle with a movable securing member at one end thereof, the movable junction plate assembly further having one or more movable coupling components each supported on a movable junction plate, the movable coupling components being connected to a control pod assembly by one or more flexible lines, the fixed junction plate assembly having a corresponding one or more fixed coupling components each supported on a fixed junction plate for mated engagement with the movable coupling components for transmitting communications between the control pod assembly and one or more tree components, the method comprising:

securing one or more alignment pins to the movable junction plate;

biasing a locking member supported by the movable junction plate assembly to a locked position for securing the connecting handle to the movable junction plate;

positioning the movable junction plate assembly for insertion of the one or more alignment pins within respective apertures provided in the fixed junction plate;

while the one or more alignment pins are within the respective apertures within the fixed junction plate, moving the locking member to an unlocked position; and thereafter rotating the connecting handle to interconnect the movable securing member with a mating fixed securing member on the fixed junction plate assembly.

17. The method as defined in claim 16, further comprising:

removably affixing a bushing to the fixed junction plate, the bushing including the mating fixed securing member thereon.

18. The method as defined in claim 16, further comprising:

interconnecting the locking member with at least one of the one or more alignment pins.

19. The method as defined in claim 16, further comprising:

spacing a protective shield between the fixed junction plate and a grasping end of the connecting handle to protect the one or more flexible lines.

20. The method as defined in claim 16, further comprising:

pivotably mounting an extension arm assembly to the control pod assembly;

supporting the movable junction plate assembly from the extension arm assembly;

extending and contracting an arm of the extension arm assembly along an extension axis; and moving the movable junction plate assembly within a preselected zone of control while supported by the extension arm assembly.

* * * * *